US005205475A

United States Patent [19]

Shibahara et al.

[11] Patent Number: 5,205,475

[45] Date of Patent: Apr. 27, 1993

[54] SEALED LETTERS, POSTCARDS AND LIKE CONFIDENTIAL SHEETS, AND PAPER, CONTINUOUS FORM OR DOCUMENT SHEET FOR PREPARING SAME

[75] Inventors: Kenji Shibahara; Norio Hochin, both of Osaka, Japan

[73] Assignees: Kabushiki Kaisha Challenge Five; Evercoat Kabushiki Kaisha, both of Osaka, Japan

[21] Appl. No.: 324,087

[22] Filed: Mar. 16, 1989

[30] Foreign Application Priority Data

Dec. 16, 1988 [JP] Japan ..... 63-163627

[51] Int. Cl.[5] ..... B42D 15/04

[52] U.S. Cl. ..... 229/92.8

[58] Field of Search ..... 229/92.8

[56] References Cited

U.S. PATENT DOCUMENTS

| | | | |
|---|---|---|---|
| 225,319 | 3/1880 | Barton | 229/92.8 |
| 576,552 | 2/1897 | Cook | 229/92.8 |
| 884,701 | 4/1908 | Borden | 229/92.8 |
| 906,774 | 12/1908 | Colwell | 229/92.8 |
| 922,035 | 5/1909 | Pifer | 229/92.8 |
| 961,829 | 6/1910 | Wooldridge | 229/92.8 |
| 1225,071 | 5/1917 | Spotswood | 229/92.8 |
| 1,244,161 | 10/1917 | Andres | 229/92.3 |
| 1,886,669 | 11/1932 | Gillespie | 229/92.8 |
| 2,018,984 | 10/1935 | Mackelenbergh | 229/92.8 |
| 2,159,486 | 5/1939 | Mayer | 229/92.8 |
| 2,363,472 | 11/1944 | Ritter | 229/92.8 |
| 3,329,333 | 7/1967 | Ormond | 229/92.8 |
| 3,399,825 | 9/1968 | Kirchof | 229/92.8 |
| 3,762,630 | 10/1973 | Braznell | 229/92.8 |
| 4,167,241 | 9/1979 | Zumbrunn . | |
| 4,742,954 | 5/1988 | Shishido | 283/94 |
| 4,749,124 | 6/1988 | Bazan | 229/92.8 |
| 4,801,074 | 1/1989 | Ikeda | 229/71 |
| 4,817,989 | 4/1989 | Pendergast | 229/92.8 |

FOREIGN PATENT DOCUMENTS

| | | | |
|---|---|---|---|
| 2480196 | 10/1981 | France | 229/92.3 |
| 59-41113 | 11/1984 | Japan . | |
| 60-142970 | 9/1985 | Japan . | |
| 254552 | 10/1989 | Japan | 229/68 R |
| 20868 | of 1894 | United Kingdom | 229/68 R |
| 1002 | of 1904 | United Kingdom | 229/68 R |

*Primary Examiner*—Stephen P. Garbe

[57] ABSTRACT

A confidential sheet in the form of a sealed letter, postcard or the like and having a sheet body bearing the information to be concealed on one surface thereof, the confidential sheet being formed in a lapped state by folding the sheet body in at least two with the information bearing surface inside. The body comprises means for preventing the information from being seen through from outside.

A paper for preparing the confidential sheet has a body bearing information on one side thereof and comprising means for preventing the information from being seen through the other side thereof.

A continuous form for successively making a plurality of sealed letters, postcards or like confidential sheets bearing concealable information, the body of the form bearing the information on one side thereof and comprising means for preventing the information from being seen through the other side thereof.

A document sheet for preparing a sealed letter, postcard or like confidential sheet bearing concealable information, the body of the document sheet bearing the information on one side thereof and comprising means for preventing the information from being seen through the other side thereof.

1 Claim, 17 Drawing Sheets

FIG. 21
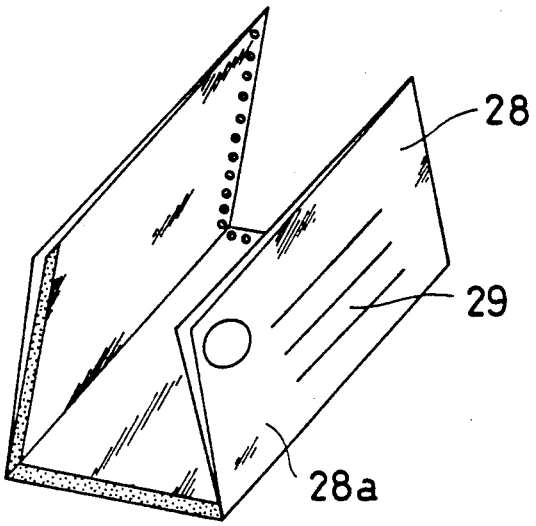
FIG. 22b
FIG. 22a
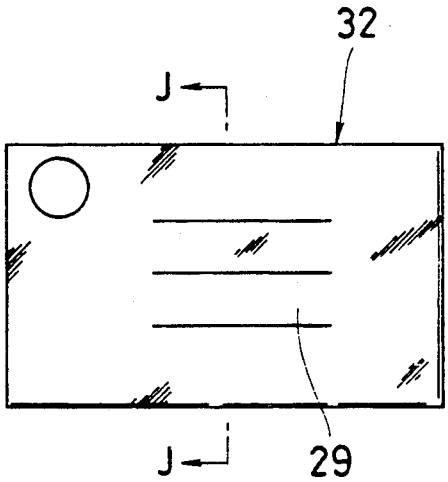
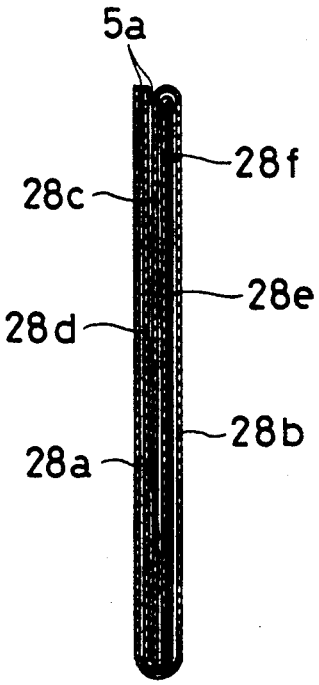

SEALED LETTERS, POSTCARDS AND LIKE CONFIDENTIAL SHEETS, AND PAPER, CONTINUOUS FORM OR DOCUMENT SHEET FOR PREPARING SAME

FIELD OF THE INVENTION

The present invention relates to postal sheets, such as sealed letters and postcards, for use in holding communications or the like confidential, confidential sheets, such as credit cards, certificates, receipts and business forms, bearing information to be held in secret, and paper, continuous form or document sheet for preparing such confidential sheets.

BACKGROUND OF THE INVENTION

Prior Art

Heretofore known are confidential sheets adapted to bear concealed information to assure secrecy and continuous strips for forming such sheets. For example, envelope sheets or strips and envelopes or the like prepared therefrom are disclosed in Examined Japanese Patent Publication SHO 51-30830, Examined Japanese Utility Model Publication SHO 59-41113, Unexamined Japanese Utility Model Publication SHO 60-142970, etc.

With reference to FIG. 24, such an envelope 10*d* comprises a first piece of paper 1*d* having an address bearing area 2*d* on its front surface, a second piece of paper 1*e* having an information bearing area 3*d* on its front surface and a third piece of paper 1*f* which are integral with one another with folds 4*d*, 4*e* formed therebetween. Adhesive coatings 5*d*, 6*d* are formed at the outer peripheral portion of the combination of the second and third paper pieces 1*e*, 1*f* on the front surface and at the outer peripheral portions of the first and second paper pieces 1*d*, 1*e* on the rear surface. The three pieces 1*d*, 1*e*, 1*f* as folded in three are joined together with the adhesive coatings 5*d*, 6*d*.

Problem of the Prior Art

The sealed letter 10*d* generally has a concealing effect because it is folded in three, whereas since the body of the letter comprises a sheet of thin paper, the interior of the letter can be seen through against the light of a fluorescent lamp, the sun or the like, and it is therefore likely that the information written in the information bearing area will be legible undesirably. Thus, the letter has the fatal problem that although inherently intended to hold the information confidential, the letter fails to ensure full secrecy.

SUMMARY OF THE INVENTION

The main object of the present invention, which has been accomplished to solve the above problem, is to almost completely prevent the information in the information bearing area from being seen through and to ensure a more reliable effect to maintain secrecy.

To fulfill the above object, the invention provides sealed letters, postcards and like confidential sheets, and paper, continuous form or document sheet for preparing such confidential sheets. The confidential sheet is in the form of a sealed letter, postcard or the like, has a sheet body bearing the information to be concealed on one surface thereof, and is formed in a lapped state by folding the sheet body in at least two with the information bearing surface inside. The sheet is characterized in that the body comprises means for preventing the information inside thereof from being seen through from outside.

The paper for preparing the confidential sheet is characterized in that the body of the paper comprises means for preventing information written on one side thereof from being seen through the other side thereof.

The continuous form is adapted to successively make a plurality of sealed letters, postcards or like confidential sheets bearing concealable information and is characterized in that the body of the form comprises means for preventing information written on one side thereof from being seen through the other side thereof.

The document sheet for preparing the confidential sheet is characterized in that the body of the document sheet comprises means for preventing information written on one side thereof from being seen through the other side thereof.

Thus, the preventing means prevents the inside of the confidential sheet prepared from the above paper, continuous form or document sheet from being seen through even against rays, with the result that the information written inside is illegible from outside.

Since the information is prevented from being seen from outside by the above means even when rays of a fluorescent lamp, the sun, etc. are used, the sealed letters, postcards and like confidential sheets of the invention have the outstanding advantage that the information written on the sheet can be held in secret more reliably and completely than heretofore possible.

The paper of the invention, incorporating the above preventing means for making confidential sheets, has the great advantage that when made into strips or dimensioned to a specified size, the paper affords sealed letters, postcards and any other confidential sheets with an excellent effect to maintain secrecy for business or personal use.

BRIEF DESCRIPTION OF THE DRAWINGS

FIG. 1(*b*) is a rear view of the same;

FIG. 1(*c*) is a view in section taken along the line A—A in FIG. 1(*a*);

FIG. 1(*d*) is a view in section taken along the line B—B in FIG. 1(*a*);

FIG. 1(*e*) is an enlarged sectional view of the portion (C) in FIG. 1(*d*);

FIG. 1(*f*) is a view in development showing the front side of the postcard;

FIG. 1(*g*) is a view in development showing the rear side of the same;

FIG. 2(*b*) is a fragmentary rear view of the same;

FIG. 3 is a side elevation schematically showing a roll of paper provided in position;

FIG. 4 is a plan view schematically showing a printing step;

FIG. 5 is a plan view schematically showing the step of cutting off ear pieces;

FIG. 6 is a plan view schematically showing a folding and adhering step;

FIG. 7 is a plan view schematically showing a severing step;

FIG. 8(*a*) is a front view of paper embodying the invention for making postcards;

FIG. 8(*b*) is an enlarged view in section taken along the line D—D in FIG. 8(*a*);

FIG. 9(*b*) is a view in development showing the rear side of the same;

FIG. 10(*b*) is a rear view of the same;

FIGS. 10(*c*) and (*d*) are views in section taken respectively along the lines E—E and F—F in FIG. 10(*a*);

FIG. 14 (*b*) is a rear view of the same;

FIG. 15 (*b*) is a rear view of the same;

FIG. 15 (*c*) is a view in section taken along the line G—G in FIG. 15 (*a*);

FIG. 16 (*b*) is a rear view of the same;

FIG. 17 (*b*) is a view in section taken along the line H—H in FIG. 17 (*a*);

FIG. 17 (*c*) is a view in section taken along the line I—I in FIG. 17 (*a*);

FIG. 20 (*b*) is a rear view showing the same;

FIG. 21 is a perspective view showing the sheet of FIG. 20 as it is being made into the sealed letter;

FIG. 22 (*a*) is a front view showing the letter as completed;

FIG. 22 (*b*) is an enlarged view in section taken along the line J—J in FIG. 22 (*a*);

FIG. 24 (*b*) is a rear view of the same.

DESCRIPTION OF THE PREFERRED EMBODIMENTS

Figure 1A:
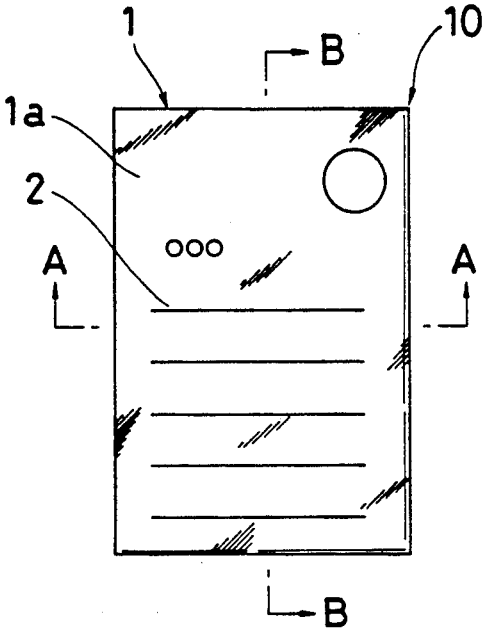
FIG. 1(*a*) is a front view of a postcard embodying the invention.
Figure 1B:
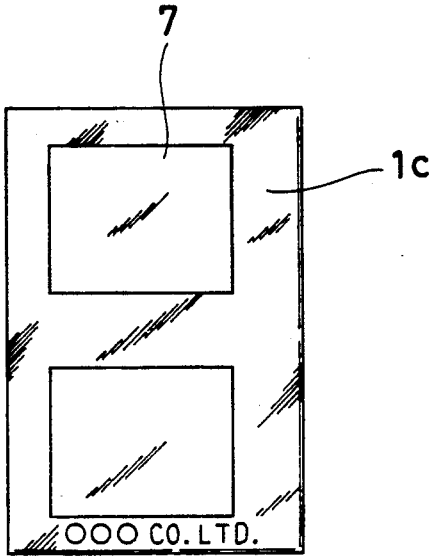
Figure 1C:
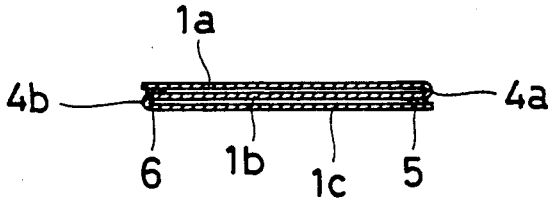
Figure 1D:
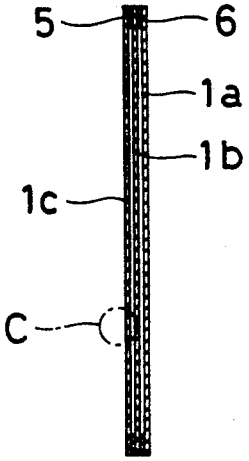
Figure 1E:
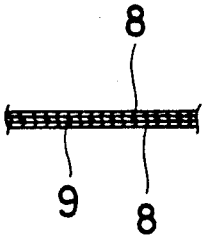
Figure 1F:
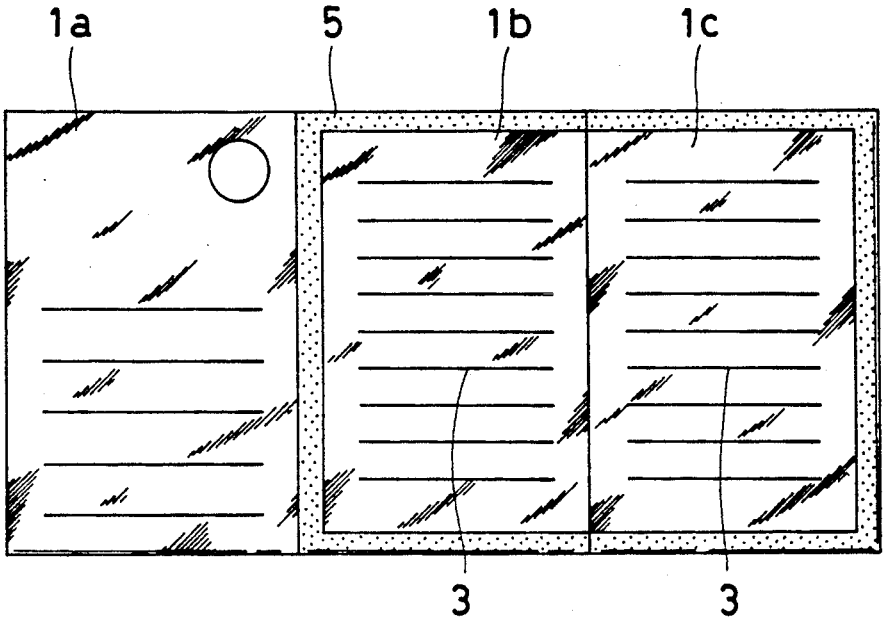
Figure 1G:
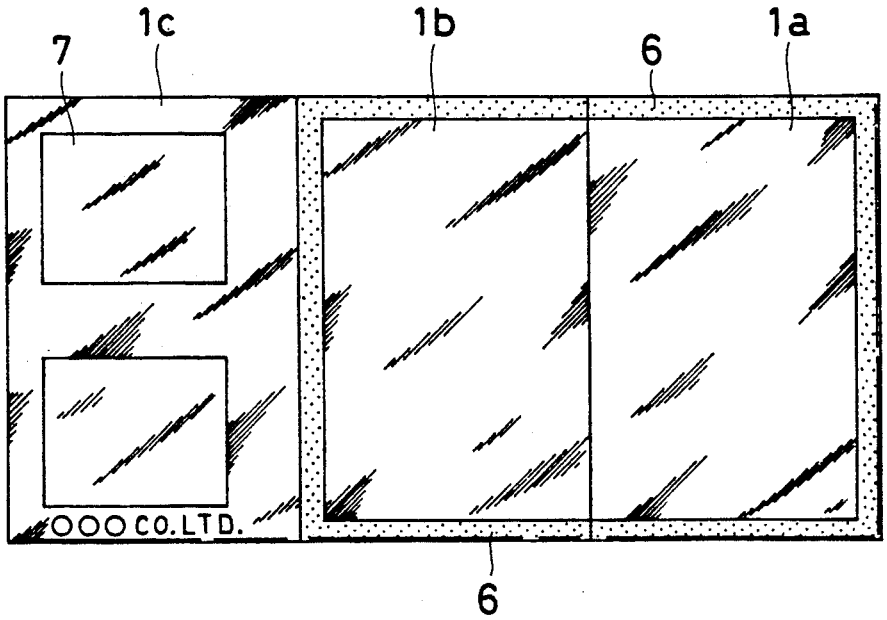

Embodiments of the invention will be described below.

FIG. 1 (*a*) is a front view of a postcard embodying the invention, FIG. 1 (*b*) is a rear view of the same, FIG. 1 (*c*) is a view in section taken along the line A—A in FIG. 1 (*a*), FIG. 1 (*d*) is a view in section taken along the line B—B in FIG. 1 (*a*), FIG. 1 (*e*) is an enlarged sectional view of the portion (C) in FIG. 1 (*d*), FIG. 1 (*f*) is a view in development showing the front view of the postcard, and FIG. 1 (*g*) is a view in development showing the rear side of the same.

With reference to these drawings, the body of a postcard, 1, comprises three pieces of paper of the same size, i.e. a first piece 1*a*, second piece 1*b* and third piece 1*c* which are integral with one another with folds 4*a*, 4*b* formed therebetween. The first piece 1*a* has on its front side an address bearing area 2 where the name of an addressee and his address are printed. Each of the second and third pieces 1*b*, 1*c* is provided on its front side with an information bearing area 3 having printed therein a communication or like information. The second and third pieces 1*b*, 1*c* are folded along the fold 4*b* with the respective information bearing areas 3, 3 inside and joined together with a hotmelt adhesive coating 5 formed on the outer peripheral portion of combination of these pieces. An adhesive coating 6 is formed also on the outer peripheral portion of the combination of the first and second pieces 1*a*, 1*b* on the rear side thereof. These pieces 1*a*, 1*b* are folded along the fold 4*a* and have their opposed rear surfaces joined together with the adhesive coating 6.

Indicated at 7 is a publicity-advertisement area provided on the rear (outer) side of the third piece 1*c*.

As shown in FIG. 1 (*e*), the postcard body 1 comprises two front and rear sheets of paper 8, 8 and a nontransparent sheet 9 interposed therebetween and in the form of an aluminum film formed by vacuum evaporation, the body 1 thus having three layers.

The body 1 of the present embodiment, i.e. postcard 10, has the above-mentioned three layers, that is, the two sheets of paper 8, 8 and the nontransparent sheet 9, so that the inner side of the body 1 is separated by the nontransparent sheet 9, whereby the information written in the information bearing areas 3 on the inner side of the body 1 is made illegible from outside. Accordingly, the postcard reliably holds the information secret from a third party while it is mailed from the addresser to the addressee.

The three-layer structure including the intermediate nontransparent sheet 9 in the form of a vacuum-deposited aluminum film gives enhanced strength to the postcard body 1 in its entirety, rendering the body less susceptible to breaking.

Moreover, water, even if deposited on the postcard 10, is blocked by the nontransparent sheet 9, which therefore obviates the likelihood that the characters and the like on the inner side of the body 1 will be obscured or disappear.

The recipient of the postcard opens the card by cutting off the outer periphery thereof as with a pair of scissors, whereupon the information on the exposed areas 3 can be readily read.

Next, a continuous form will be described which embodies the invention for making the postcard described.

Figure 2A:
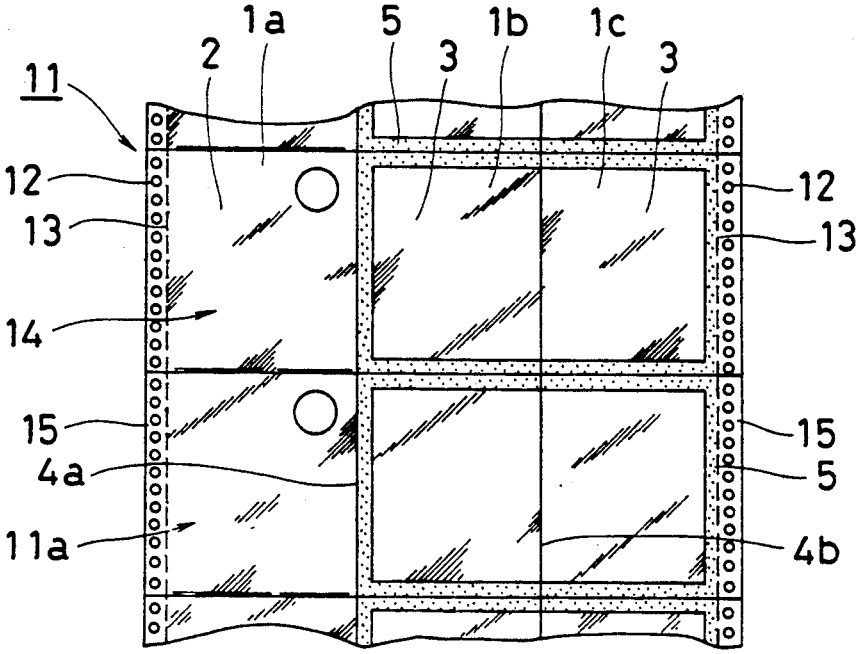
FIG. 2(*a*) is a fragmentary front view of a continuous form embodying the invention for forming postcards.
Figure 2B:
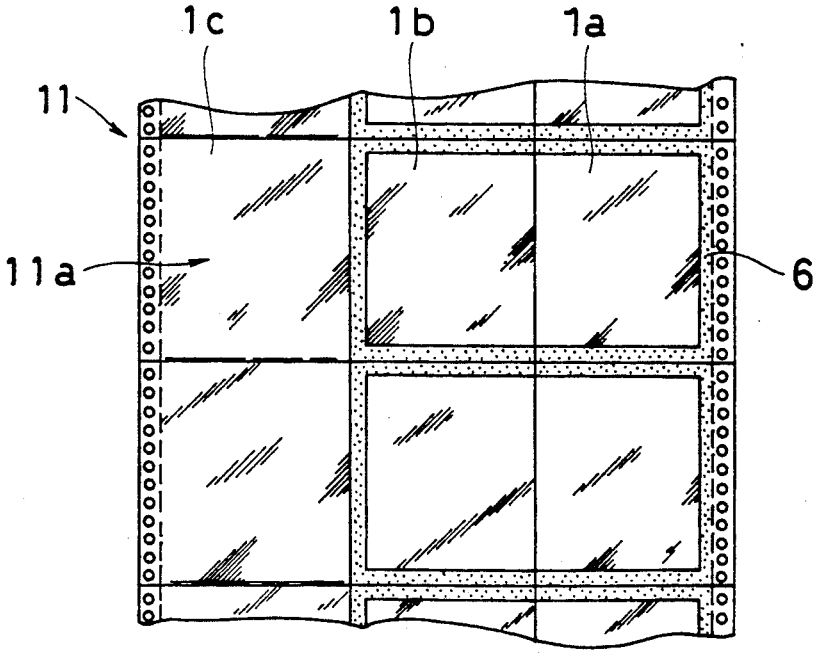

FIG. 2 (*a*) is a fragmentary front view of the continuous form, and FIG. 2 (*b*) is a fragmentary rear view of the same.

With reference to these drawings, the body 11*a* of a continuous form 11 comprises a multiplicity of unit slips 14 integrally arranged vertically and each including a first piece of paper 1*a*, second piece of paper 1*b* and third piece of paper 1*c*. These pieces have the standard size of the postcard and are formed integrally as arranged horizontally with folds 4*a*, 4*b* provided therebetween.

The first piece 1*a* has an address bearing area 2 on its front side. Each of the second and third pieces 1*b*, 1*c* is provided on its front side with an area 3 for bearing a communication or like information. An adhesive coating 5 is formed on the front side of the combination of second and third pieces 1*b*, 1*c* at its outer peripheral portion, while an adhesive coating 6 is formed on the rear side of the combination of first and second pieces 1*a*, 1*b* at its outer peripheral portion.

The body 11*a* has a three-layer structure comprising a pair of front and rear sheets of paper 8, 8 and a nontransparent sheet 9 in the form of a vacuum-deposited aluminum film.

An ear piece 15 extending longitudinally of the body 11*a* is formed at each side edge thereof with cutting perforations 13 formed therebetween and has a multiplicity of punch holes 12.

Postcards such as the one described above are prepared from the continuous form 11 of the above construction in the following manner.

Figure 3:
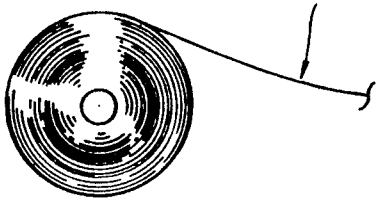
FIGS. 3 to 8 show a process for producing the postcard.

As seen in FIG. 3, the elongated continuous form 11 as rolled up is installed in place and is paid off for transport.

Figure 4:
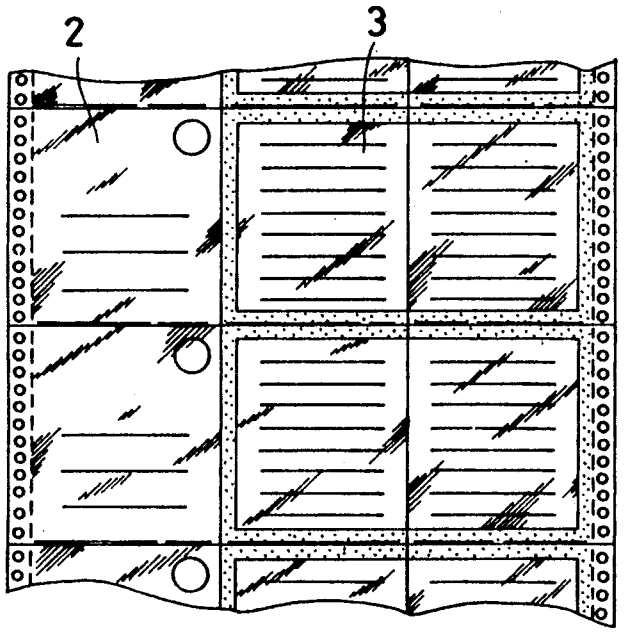

Next, the names of addressees and their addresses are printed on the first pieces 1*a* each in the specified address bearing area 2 as seen in FIG. 4, and a communication is printed on the information bearing areas 3 of the second and third pieces 1*b*, 1*c* using the printer of an electronic computer and utilizing the punch holes 12 at opposite side edges of the form 11.

Figure 5:
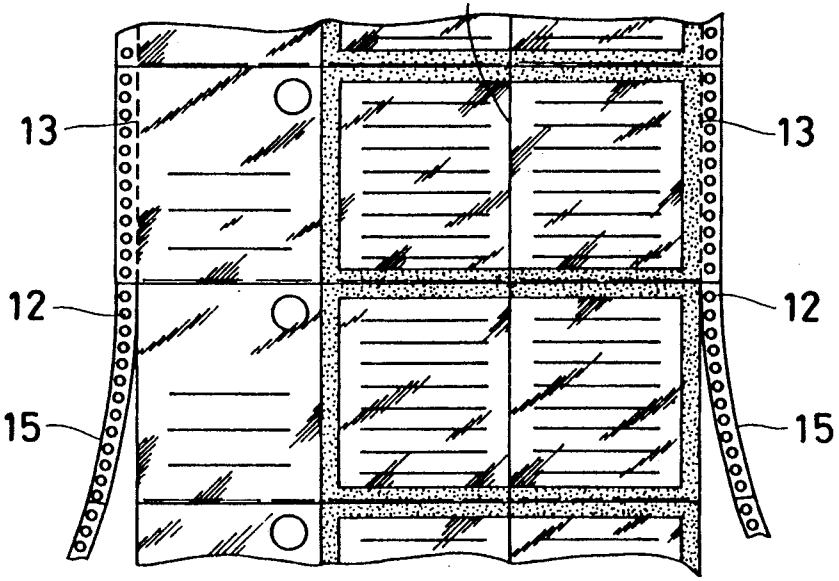

After the specified items have been printed as above, the ear pieces 15 having the punch holes 12 are removed from the side edges of the form 11 along the perforations 13 as seen in FIG. 5.

Figure 6:
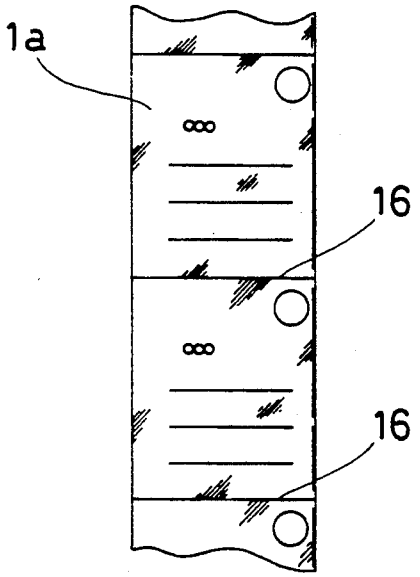

Subsequently, the continuous form 11 is folded in three along the fold 4*a* between the first and second pieces 1*a*, 1*b* and along the fold 4*b* between the second and third pieces 1*b*, 1*c* as shown in FIG. 6, and the first pieces 1*a* are affixed to the second pieces 1*b*, and the second pieces 1*b* to the third pieces 1*c* with the hotmelt adhesive coatings 5, 6 by application of heat and pressure.

In this step, the folded pieces are heated under pressure by being passed between rollers and can therefore be joined to one another without trapping any air therebetween.

Figure 7:
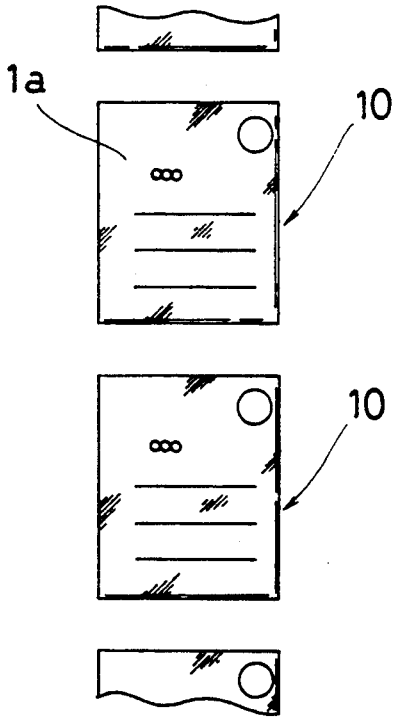

As seen in FIG. 7, the continuous form 11 is thereafter severed in succession along transverse cut lines 16, whereby postcards 10 like the embodiment 1 can be prepared automatically by a continuous operation.

Next, paper for making postcards like those described above will be described as another embodiment of the invention.

Figure 8A:
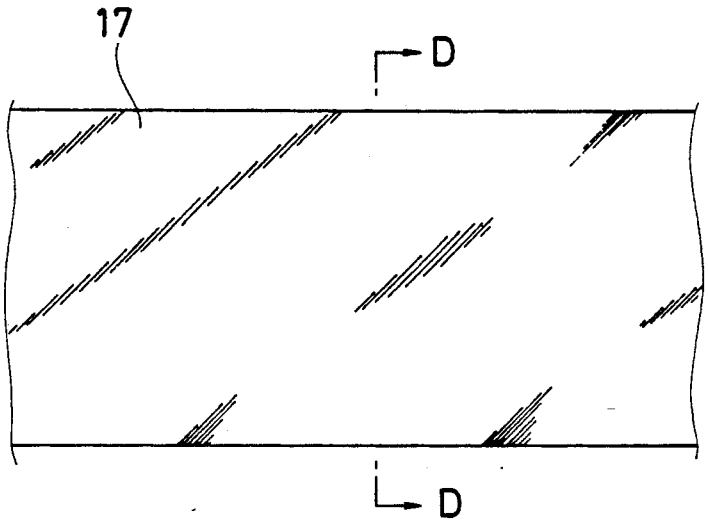
Figure 8B:
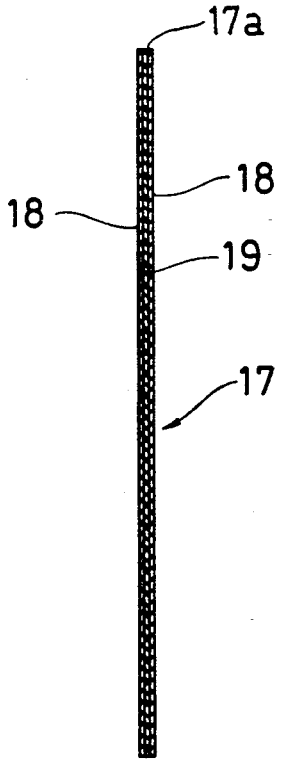

FIG. 8 (*a*) is a fragmentary front view of the postcard making paper, and FIG. 8 (*b*) is an enlarged view taken along the line D—D in FIG. 8 (*a*).

With reference to these drawings, elongated paper 17 for making postcards has a body 17*a* with a three-layer structure which comprises a pair of front and rear sheets of paper 18, 18 and a nontransparent sheet 19 in the form of an aluminum film formed by vacuum evaporation.

Postcards are prepared from the paper 17 having the above structure by forming punch holes 12, like those already described, in opposite side edge portions of the paper 17 and the desired address bearing areas 2, etc., then forming adhesive coatings 5, 6 to obtain the same postcard forming continuous form 11 as seen in FIG. 2, and subjecting the form 11 to the steps of FIGS. 3 to 7.

Figure 9A:
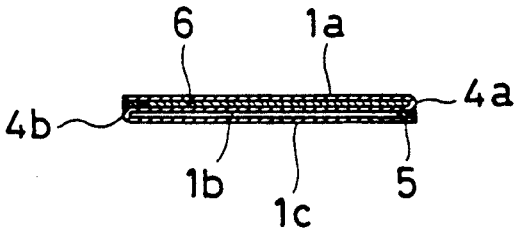
FIG. 9(*a*) is a sectional view of another embodiment of postcard.
Figure 9B:
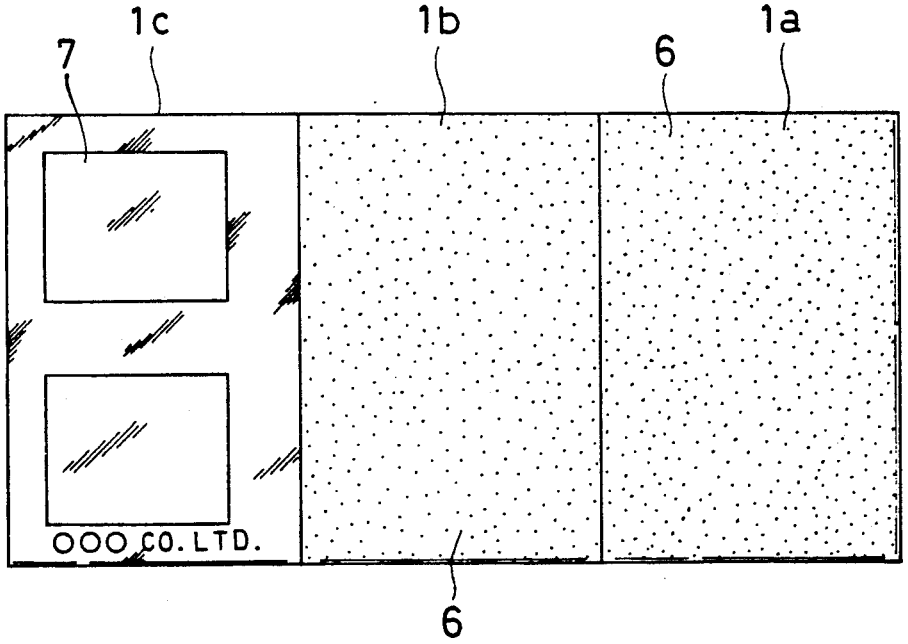
Figure 10A:
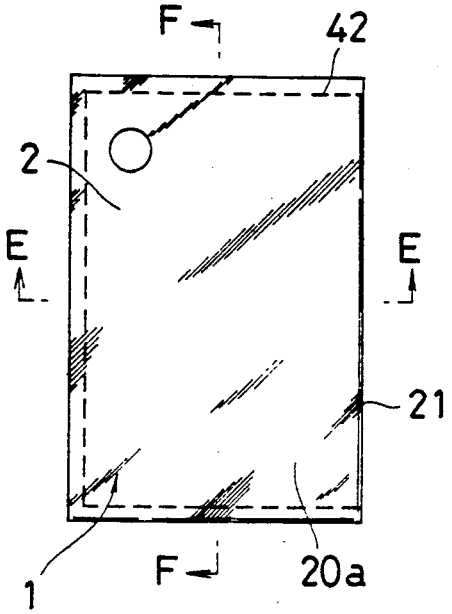
FIG. 10(*a*) is a front view of another embodiment of postcard.
Figure 10B:
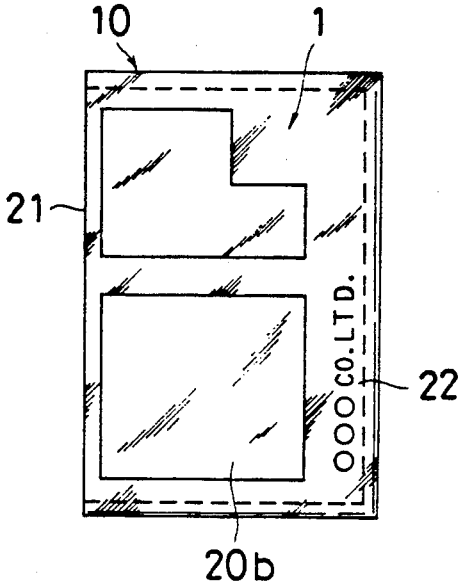
Figure 10C:
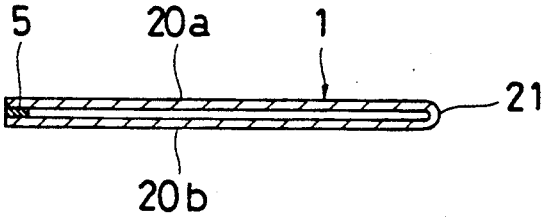
Figure 10D:
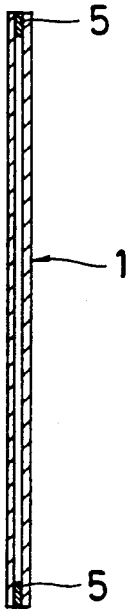

With the embodiment of postcard of FIG. 1, the adhesive coating 6 on the rear side of the combination of first and second pieces 1*a*, 1*b* is formed only at the peripheral portion, whereas the adhesive coating 6 may be formed over the entire rear side as seen in FIG. 9.

In this case, the second piece 1*b* can be separated from the third piece 1*c* after the postcard is opened, but the first piece 1*a* remains affixed to the second piece 1*b* with the adhesive coating on the entire rear side of these pieces, with the result that at least the first and second pieces 1*a*, 1*b* can be handled like a single piece of paper. The postcard can therefore be opened only between the second and third pieces 1*b*, 1*c*.

Accordingly, the postcard will be opened as if it were folded in two to expose only the inherently necessary information bearing areas with the unnecessary areas left unexposed. This enables the recipient to recognize the information bearing areas with extreme ease immediately after opening the card and is therefore advantageous.

Since the first and second pieces 1*a*, 1*b* are joined together with the adhesive applied to the entire opposed surfaces thereof, there is no likelihood that the postcard will have an inadvertently increased thickness due to trapped air. This results in the advantage that the postcard provided meets the stringent standards as to the thickness, weight, etc.

FIG. 10 (*a*) is a front view showing another embodiment of postcard, FIG. 10 (*b*) is a rear view of the same, FIG. 10 (*c*) is a view in section taken along the line E—E in FIG. 10 (*a*), and FIG. 10 (*d*) is a view in section taken along the line F—F in FIG. 10 (*a*).

With reference to these drawings, the body 1 of a paper postcard 1 comprises two sheets 20*a*, 20*b* folded over each other along a fold 21 and joined together with a hotmelt adhesive coating 5 formed over each of the opposed surfaces thereof along its three edges.

One of the sheets, 20*a*, has an address bearing area 2 on its outer side as shown in FIG. 10 (*a*). The outer side of the other sheet 20*b* bears the name of a company 22 as the sender, and a public notice or advertisement printed in color.

Each of the sheets 20*a*, 20*b* has an information bearing area 3.

Indicated at 42 are perforations serving as means for opening the body 1, i.e., for separating the two sheets 20*a*, 20*b* joined together with the adhesive coatings 5.

Since the postcard 10 of the present embodiment comprises two sheets 20*a*, 20*b* joined together with the adhesive 5 applied to the three edge portions of each sheet, the message printed on the inner side of the sheets 20*a*, 20*b* is completely concealed by these pieces 20*a*, 20*b* and therefore completely held confidential during mailing.

With the present embodiment as is the case with the foregoing embodiments, the postcard body 1 comprises three layers, i.e., two pieces of paper 8, 8 and a nontransparent sheet 9. Accordingly, the inside information will in no way be seen through from outside but can be held in secret effectively.

Figure 11:
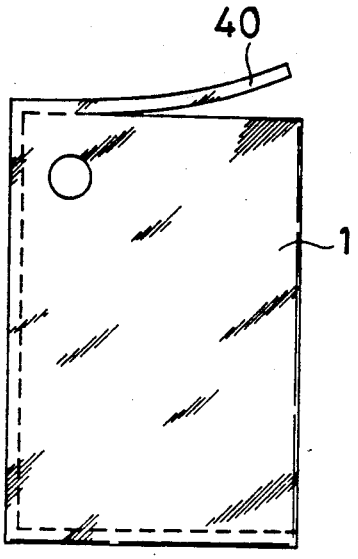
FIG. 11 is a front view showing the postcard of FIG. 10 as it is being opened.
Figure 12:
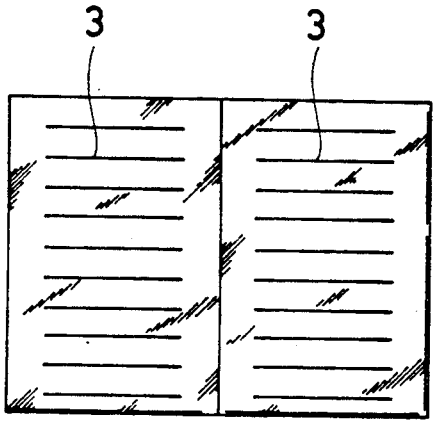
FIG. 12 is a front view in development showing the same.

On the other hand, the recipient of the postcard 10 can easily open the body 1 as seen in FIG. 12 to readily recognize the information by cutting off an ear piece 40 along the perforations 42 as shown in FIG. 11.

Thus, the postcard of the present embodiment is adapted to hold the message or the like in secret, is easy to open and has a novel but simple structure comprising two sheets of paper 20*a*, 20*b* only.

Figure 13:
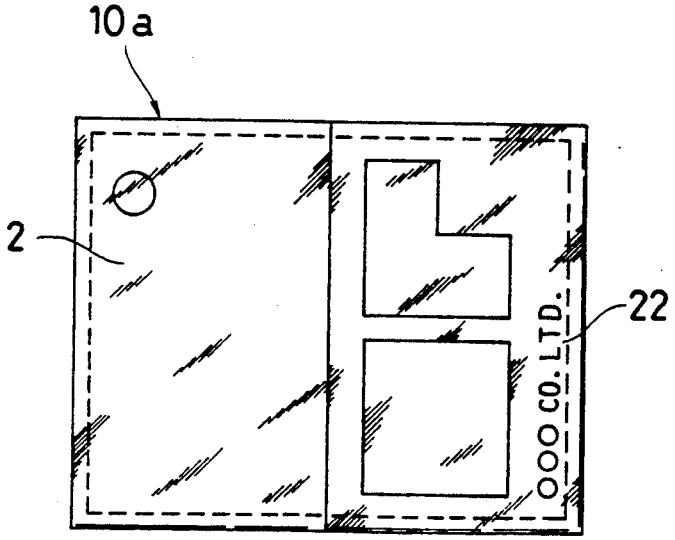
FIG. 13 is a front view of a sheet for making the postcard of FIG. 10.

The postcard 10 is prepared from a document sheet 10*a* shown in FIG. 13.

More specifically, postcards such as the one shown in FIG. 10 are prepared by feeding a multiplicity of such sheets 10*a* one after another to a laser printer or the like to print the contemplated items in the address area 2 and information bearing areas 3 of each sheet 10*a*, folding the sheets in two by a folding machine, and joining the opposed portions of each sheet 10*a* with an adhesive by application of pressure with rollers or the like. In this case, both sides of the sheet 10*a* can be printed on by the laser printer.

Figure 14A:
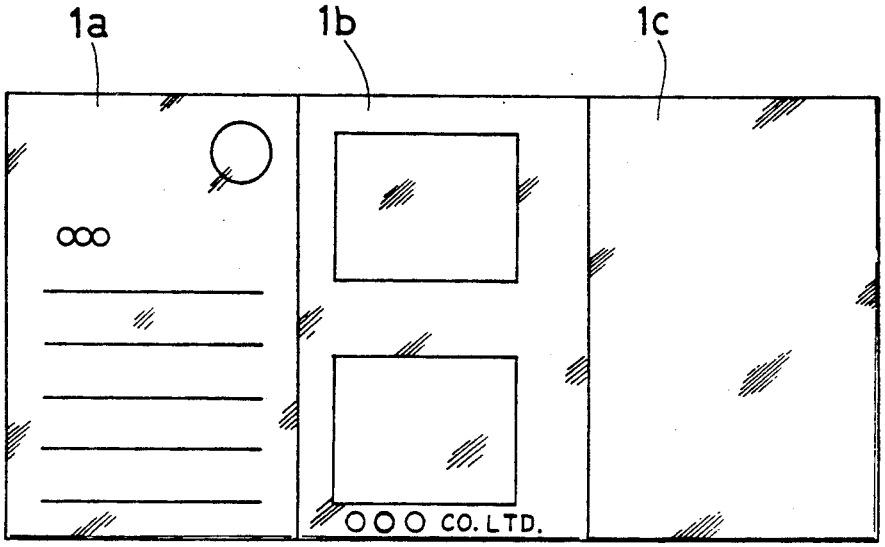
FIG. 14 (*a*) is a front view showing a document sheet embodying the invention for making a sealed letter.
Figure 14B:
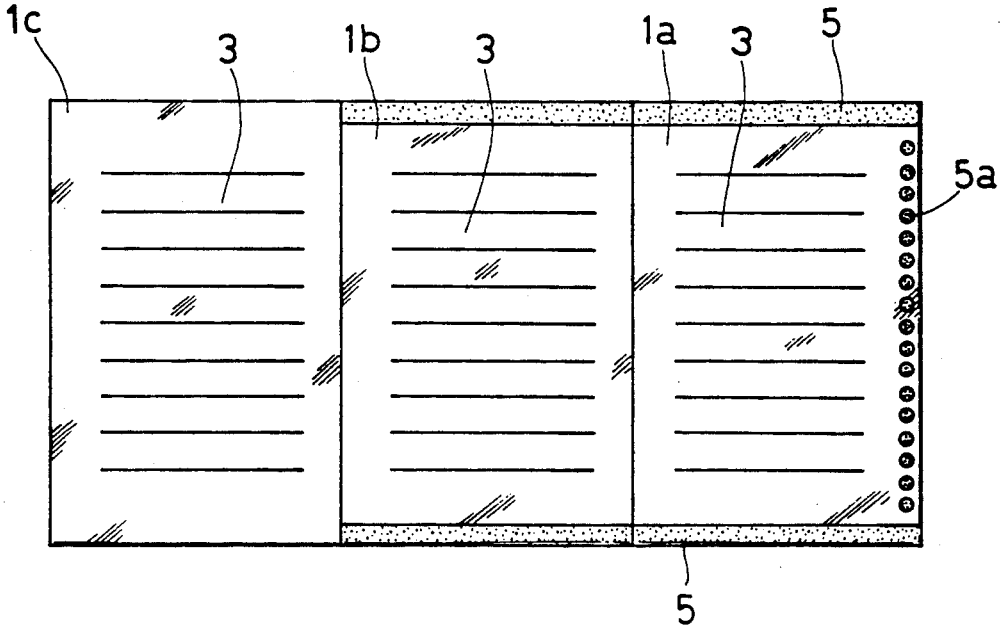
Figure 15A:
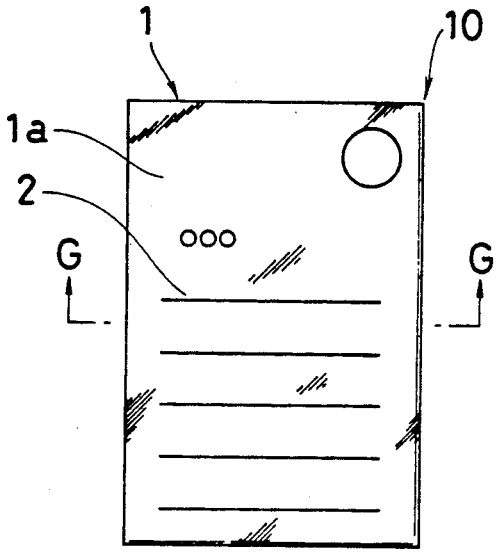
FIG. 15 (*a*) is a front view of the sealed letter made from the document sheet of FIG. 14.
Figure 15B:
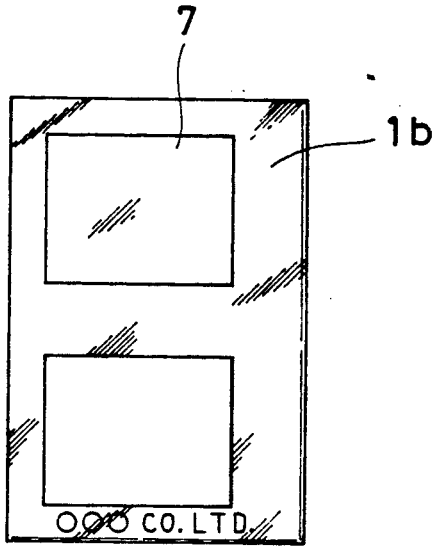
Figure 15C:
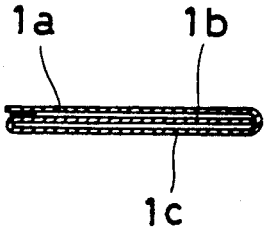

FIG. 14 (*a*) is a front view showing a document sheet, as another embodiment, for making a sealed letter, FIG. 14 (*b*) is a rear view of the same, FIG. 15 (*a*) is a front view of the letter made from the sheet of FIG. 14, FIG. 15 (*b*) is a rear view of the same, and FIG. 15 (*c*) is a view in section taken along the line G—G in FIG. 15 (*a*).

This embodiment has the same structure as the embodiment of FIG. 1 in that an address bearing area 2 is formed on the front side of a first paper piece 1*a* but differs therefrom in that it has an information bearing area 3 on the rear side of each of the first paper piece 1*a*, second paper piece 1*b* and third paper piece 1*c*.

The second piece 1*b* has a publicity-advertisement area 7 on its front side.

An adhesive coating 5 is formed on the rear side of the first and second pieces 1*a*, 1*b* at their upper and lower edge portions. Spots of adhesive, 5*a*, are also formed along the outer side edge of the first piece 1*a* on the rear side.

With the present embodiment, the first and third pieces 1*a*, 1*c* are folded over the second piece 1*b*, so that the inner side of all the three pieces 1*a* to 1*c* is concealed. Accordingly, the three surfaces of the paper pieces are usable as the information bearing areas 3 as seen in FIG. 14 (*b*). The embodiment therefore has the advantage of being capable of bearing an increased amount of information.

The letter can be readily opened by cutting off the upper and lower edge portions of the body 1 inwardly of the adhesive coatings 5 and separating off the outer side edge of the body 1 where the spots of adhesive 5*a* are formed.

The sealed letter 10 of this embodiment is prepared by printing the contemplated items on the address bearing area 2 and the information bearing areas 3 of the document sheet 10*a* shown in FIG. 14, inwardly folding the sheet 10*a* in three and joining the folded pieces together under pressure with the adhesive coatings 5 and spots 5*a*.

Figure 16A:
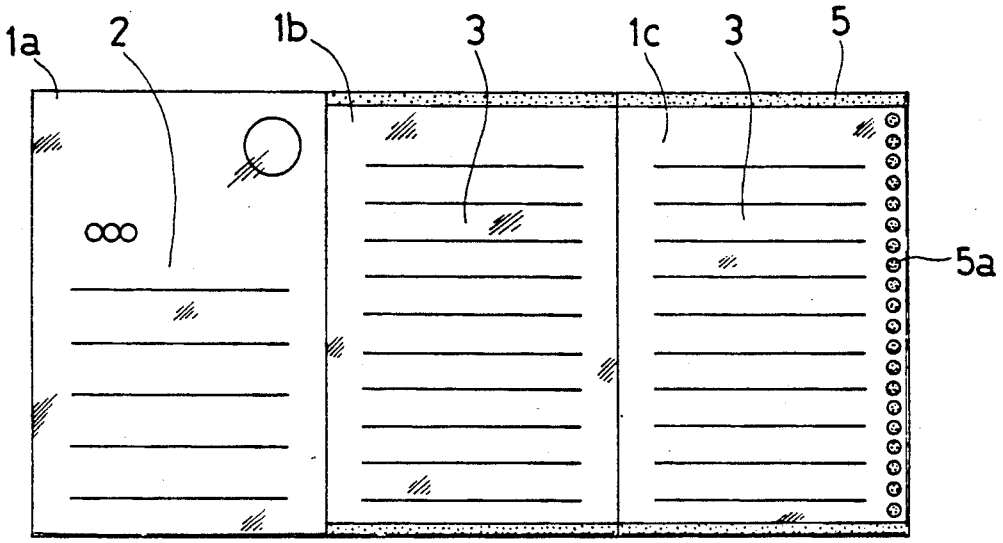
FIG. 16 (*a*) is a front view of a document sheet embodying the invention for making a sealed letter.
Figure 16B:
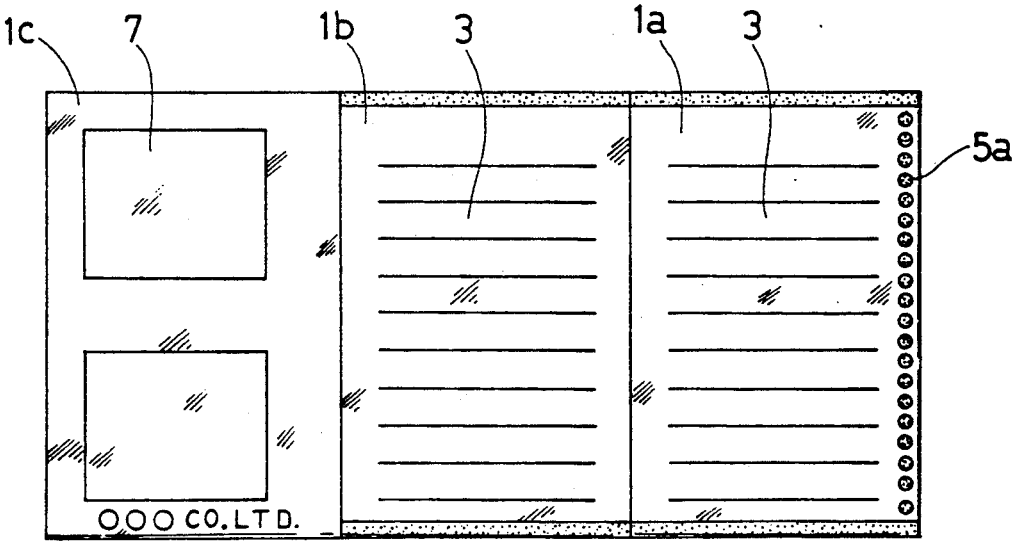

FIG. 16 (*a*) is a front view showing another embodiment of document sheet for making a sealed letter, and FIG. 16 (*b*) is a rear view of the same.

This embodiment is in common with the embodiment of FIG. 1 in that an address area 2 is provided on the front side of a first paper piece 1*a*, with information bearing areas 3, 3 on the front side of second and third paper pieces 1*b*, 1*c*, but differs therefrom in that the information bearing area 3 is provided also on each of the first and second pieces 1*a*, 1*b* on the rear side thereof.

Further with the present embodiment, spots of adhesive, 5*a*, are applied to the rear side of the third piece 1*c* and the rear side of the first piece 1*a*, each at its outer side edge, such that like the embodiment of FIG. 14, the letter can be entirely laid open.

This embodiment has the advantage of being capable of bearing an increased amount of information because the information bearing area 3 can be formed on four surfaces of paper pieces.

Like the postcard of FIG. 1, the document sheet is folded in three generally in a Z-form to provide the sealed letter.

Figure 17A:
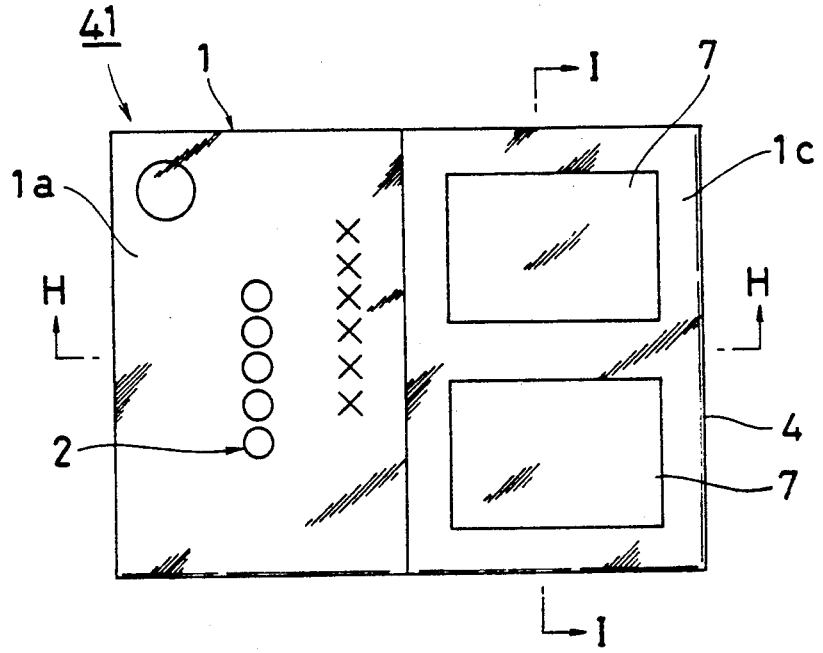
FIG. 17 (*a*) is a front view of a postcard as another embodiment.
Figure 17B:
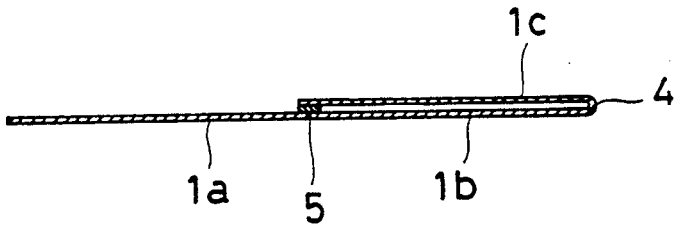
Figure 17C:
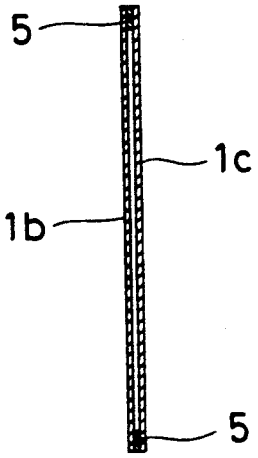

FIG. 17 (*a*) is a front view showing a postcard as another embodiment, FIG. 17 (*b*) is a view in section taken along the line H—H in FIG. 17 (*a*), and FIG. 17 (*c*) is a view in section taken along the line I—I in FIG. 17 (*a*).

With reference to these drawings, the body 1 of the postcard 41 shown is in the form of a single sheet of paper including three pieces 1*a*, 1*b*, 1*c* which are integral with one another and identical in size. The piece 1*a* has an address bearing area 2 on its one side. The pieces 1*b*, 1*c* each have an information bearing area 3 on one side. The two pieces 1*b*, 1*c* are folded along a fold 4 with the information bearing areas 3, 3 inside so that only the first piece 1*a* with the address area 2 is projected beyond the other pieces 1*b*, 1*c*. The peripheral portions of the lapped pieces are joined together with a hotmelt adhesive 5. The postcard body 1 thus folded has an overall size meeting the standard for the postcard.

With the postcard 41 of the present embodiment as folded in two as stated above, only the first piece 1*a* having the address area 2 is exposed and projected outward from the second and third pieces 1*b*, 1*c* having the information bearing areas 3, so that the name of an addressee, his address, communication and like items can be printed on one side of the postcard body without impairing the function to hold the information in secret and free of any interference with the address area. This permits the use of an automatic printer or the like for automatically printing the desired items, consequently making it possible to automatically produce confidential postcards of the doubled type in large quantities.

Further because the postcard body 1 as folded in two is dimensioned in its entirety to the standard size, the postcard has the advantage that it can be mailed as such in conformity with the postal regulation.

Figure 18A:
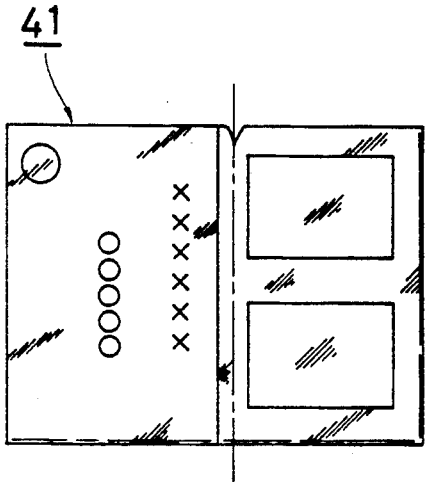
FIGS. 18 (*a*) and (*b*) are front views showing how to cut the postcard of FIG. 17 for opening.
Figure 18B:
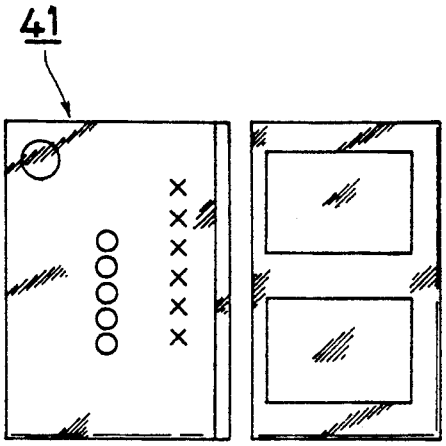
Figure 19:
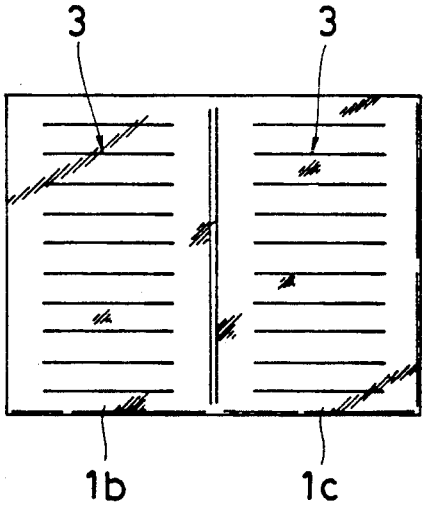
FIG. 19 is a front view in development showing the postcard as it has been opened.

The recipient of the postcard 41 can easily open the body 1 to readily recognize the information as seen in FIG. 19 by cutting off the pieces 1*b*, 1*c* at their inner side edge portions from the piece 1*a* with a pair of scissors as seen in FIG. 18.

Figure 20A:
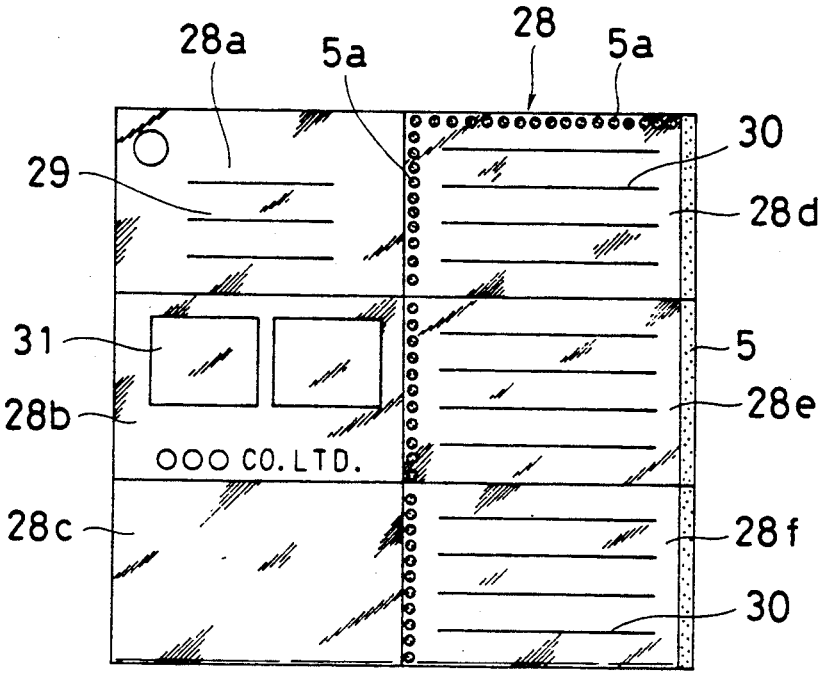
FIG. 20 (*a*) is a front view showing another embodiment of document sheet for making a sealed letter.
Figure 20B:
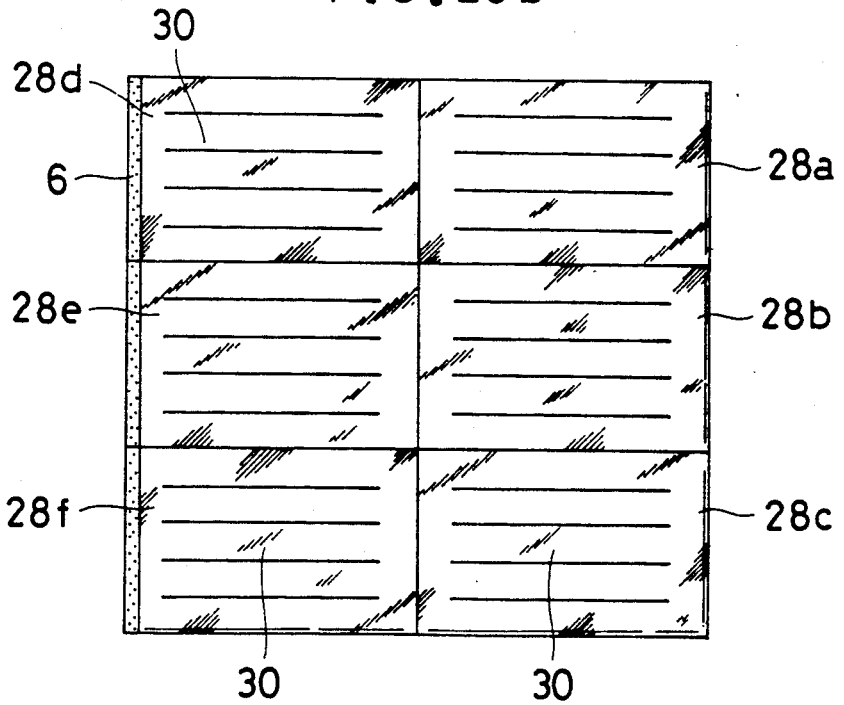

FIG. 20 (*a*) is a front view showing another embodiment of document sheet for making a sealed letter, and FIG. 20 (*b*) is a rear view of the same.

The body 28 of this document sheet comprises six paper pieces 28*a*,28*b*, 28*c*,28*d*, 28*e*, 28*f* which are integrally formed. The first piece 28*a* has an address area 29 on its front side. The second piece 28*b* has a publicity-advertisement area 31 on its front side. Information bearing areas 30 are formed on the front side of the fourth, fifth and sixth pieces 28*d*, 28*e*, 28*f* and on the rear side of all the pieces 28*a* to 28*f*. Adhesive coatings 5, 6 are formed at one side edge of the body 28 on the front and rear sides thereof, respectively. Spots of adhesive 5*a* are applied to the front side of the fourth, fifth and sixth pieces 28*d*, 28*e*, 28*f* along their inner side edges and along the upper edge of the fourth piece 28*d* generally in an inverted L-shaped arrangement.

The sheet is folded in six as seen in FIG. 21 as by an automatic folding machine, whereby a sealed letter 32 can be obtained as illustrated in FIGS. 22 (*a*) and (*b*).

This embodiment has nine information bearing areas 30 in total on both the front and rear sides of the body 28 and therefore has the advantage of being capable of bearing an exceedingly larger amount of information than conventional sealed letters.

With the embodiments described above, the body 1 of the postcard has the three layers of front and rear sheets of paper 8, 8 and the nontransparent sheet 9 therebetween as means for preventing the information in the area 3 from being seen through from outside, whereas the preventing means is not limited to this structure.

For example, the nontransparent sheet 9, which is a vacuum-deposited aluminum film, may alternatively be a colored film, nontransparent paper or aluminum foil. A colored adhesive may be provided between the two sheets of paper to serve as a substitute for the nontransparent sheet 9.

Instead of using the nontransparent sheet 9, a sheet of paper may be directly coated with aluminum by vacuum evaporation to provide the preventing means.

In any case, the preventing means is not limited specifically.

The sheet material for providing the postcard or sealed letter is not limited to paper used in the foregoing embodiments. For example, synthetic resin sheets are usable. It is also possible to use a biaxially oriented polypropylene film prepared by expanding a biaxially oriented polypropylene.

Accordingly, the term the "paper" for use in the present invention for preparing the confidential sheet not only refers to paper in a narrow sense but is also used in a broad sense including synthetic resin paper and the like. Thus, the term means a plain sheet before printing.

The synthetic resin material to be used must be coated with an ink so as to be amenable to writing.

Figure 23:
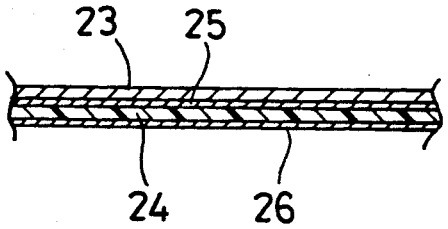
FIG. 23 is an enlarged fragmentary view showing the structure of another embodiment of sheet.
Figure 24A:
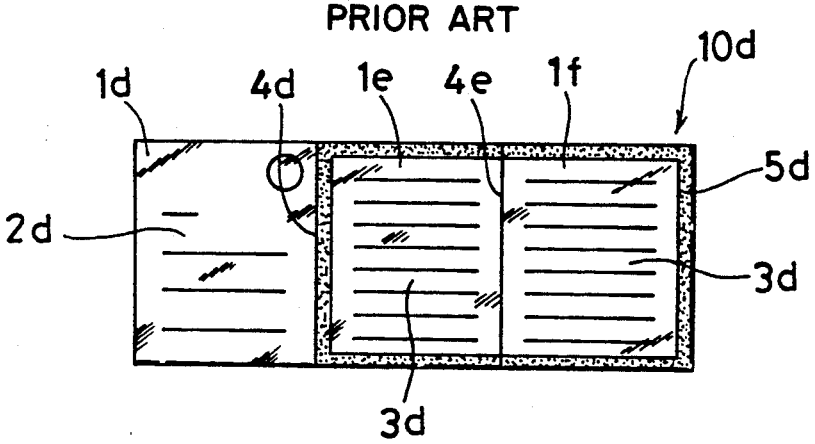
FIG. 24a PRIOR ART
FIG. 24 (*a*) is a front view showing a conventional sealed letter.
Figure 24B:
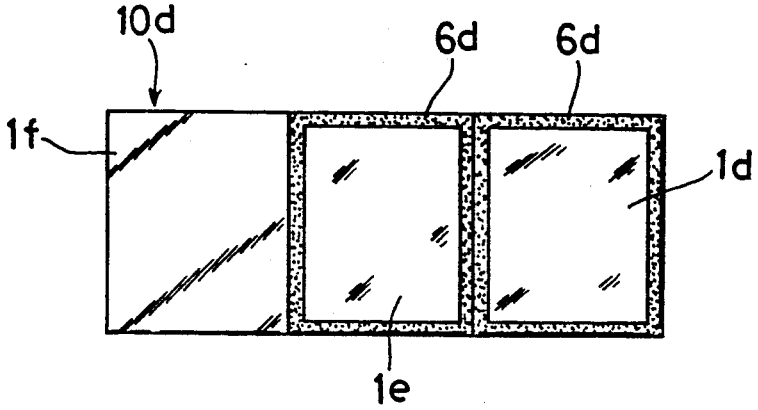
FIG. 24b PRIOR ART

As an example of application of a synthetic resin material, FIG. 23 shows a sheet which comprises paper 23, and a synthetic resin sheet 24 affixed to the paper with an adhesive 25 and coated on its outer surface with an ink 26 for rendering the sheet 24 amenable to writing. The rear surface of the sheet 24 is coated with aluminum by vacuum evaporation (not shown) to make the sheet 24 nontransparent on the rear side.

In any case, the synthetic resin material, when included in the sheet body, produces an effect to maintain secrecy by concealing and further gives enhanced strength and prevents penetration of water as already stated.

Although the foregoing embodiments have been described with reference to postcards and sealed letters, the confidential sheet of the invention is not limited to use as these articles but is also usable, for example, for credit cards, certificates, greeting cards, receipts, business documents and the like. Thus, the present sheet can be used as any sheetlike article for confidential or concealing purposes regardless of whether it is intended for postal use.

Furthermore, the location where the adhesive is to be applied is not limited to those of the above embodiments but can be altered as desired depending on the type or structure of the confidential sheet.

The adhesive is not limited either to the hotmelt type used in the above embodiments, while the adhesive per se is not essential to the present invention; the means for joining the paper sheets together is not limited specifically.

Furthermore, the confidential sheet can be opened by cutting as with scissors, by separation along perforations or by any other means.

Printing of publicity notices or advertisements is of course not essential.

The continuous form or document sheet of the above embodiments is used primarily for business uses for automatically preparing a large quantity of postcards, sealed letters or like confidential sheets, whereas such form or sheet is not always limited to business uses but is also applicable to personal or family uses.

For family uses, the document sheets shown for example in FIGS. 13, 14, 16, etc. may be sold at stationary stores for consumers. The person purchasing such a sheet will fill out the sheet, fold the sheet in two or three and press the fold as by ironing, whereby the desired postcard or the like will be readily made.

Accordingly the method of writing information in the area 3 is not limited to printing but handwriting may also be resorted to.

Further the number in which the sheet is to be folded is not limited to two or three insofar as the sheet is in a lapped state as folded in at least two. The term "lapped state" is to be interpreted as including such a state of the confidential sheet as prepared by folding the sheet body first and then cutting the fold portion.

The means to be employed in the process for preparing various confidential sheets, the procedure therefor, etc. are not limited specifically.

The confidential sheet is not limited either, in size or shape but can be sized or shaped differently as desired according to the type of the sheet. For example, postcards need to be sized in conformity with the postal regulation.

What is claimed is:

1. A confidential sheet in the form of a sealed letter, postcard or the like and having a sheet body bearing the information to be concealed on one surface thereof, the confidential sheet being formed in a lapped state by folding the sheet body in at least two with the information bearing surface inside, said sheet body comprises front and back sheets, with a nontransparent sheet interposed and permanently secured therebetween for preventing the information on the inner surface from being seen through from outside, and said front and back sheets are formed of paper.

* * * * *

UNITED STATES PATENT AND TRADEMARK OFFICE

CERTIFICATE OF CORRECTION

PATENT NO. : 5,205,475

DATED : April 27, 1993

INVENTOR(S) : Kenji Shibahara and Norio Hochin

It is certified that error appears in the above-indentified patent and that said Letters Patent is hereby corrected as shown below:

On the Title Page, under the Heading [73] Assignees: change "Kabushiki Kaisha Challenge Five; Evercoat Kabushiki Kaisha, both of Osaka, Japan" to -- Evercoat Kabushiki Kaisha, Osaka, Japan --

Signed and Sealed this

Twelfth Day of April, 1994

Bruce Lehman

*Attest:*

BRUCE LEHMAN

*Commissioner of Patents and Trademarks*

*Attesting Officer*